United States Patent [19]

Denley

[11] Patent Number: 4,468,145

[45] **Date of Patent: * Aug. 28, 1984**

[54] KEYBOARD SPACE BAR STABILIZER

[75] Inventor: Ronald S. Denley, Woodstock, Ill.

[73] Assignee: Oak Industries, Inc., Rancho Bernardo, Calif.

[ * ] Notice: The portion of the term of this patent subsequent to May 24, 2000 has been disclaimed.

[21] Appl. No.: 493,627

[22] Filed: May 11, 1983

Related U.S. Application Data

[63] Continuation-in-part of Ser. No. 359,217, Mar. 18, 1982, Pat. No. 4,384,796.

[51] Int. Cl.[3] ..... B41J 5/08

[52] U.S. Cl. ..... 400/496; 400/495.1

[58] Field of Search ..... 400/496, 491.2, 495, 400/495.1, 479

[56] References Cited

U.S. PATENT DOCUMENTS

| | | | |
|---|---|---|---|
| 3,720,801 | 3/1973 | Yanaga | 400/496 X |
| 4,010,838 | 3/1977 | Sims, Jr. | 400/496 |
| 4,384,796 | 5/1983 | Denley | 400/496 |

FOREIGN PATENT DOCUMENTS

| | | | |
|---|---|---|---|
| 0046575 | 3/1982 | European Pat. Off. | 400/496 |
| 2077195 | 12/1981 | United Kingdom | 400/495 |

OTHER PUBLICATIONS

IBM Technical Disclosure Bulletin, "Self-Biasing Space Bar Stabilizer Mechanism", by R. H. Harris, vol. 21, No. 9 Feb. 1979, pp. 3725-3726.

*Primary Examiner*—Edgar S. Burr
*Assistant Examiner*—John A. Weresh
*Attorney, Agent, or Firm*—Kinzer, Plyer, Dorn & McEachran

[57] ABSTRACT

A keyboard has a space bar centrally mounted on a plunger and supported at its ends by a torsion rod. The torsion rod has crank arms at its ends which are connected to the space bar and serve to distribute the actuating force on the space bar so that the plunger will move smoothly up and down and not bind. An attachment element in the nature of a yoke is provided for connecting the crank arms of the torsion rod to the space bar. A spring connected to the space bar flexibly engages the crank arm. The attachment element accommodates the natural, arcuate motion of the crank arm while simultaneously maintaining engagement with the crank arm to secure the space bar to the torsion rod and prevent the space bar from rattling or vibrating.

6 Claims, 9 Drawing Figures

Fig. 1.
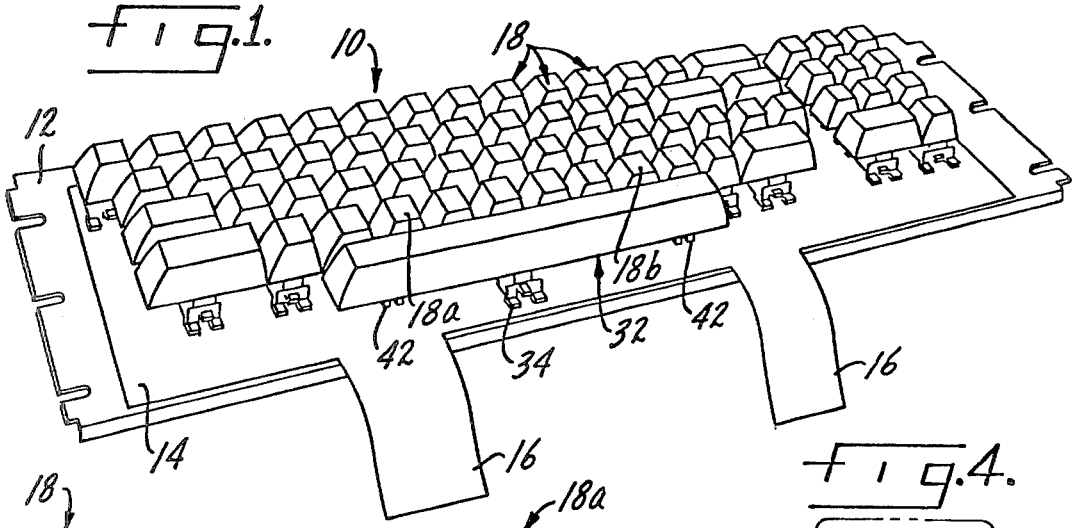
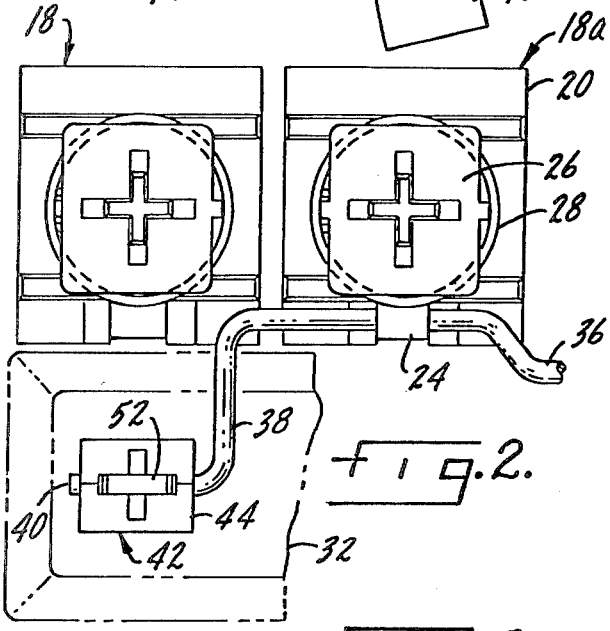
Fig. 2.
Fig. 4.
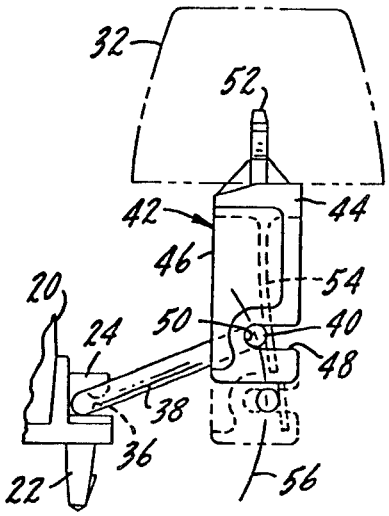
Fig. 3.
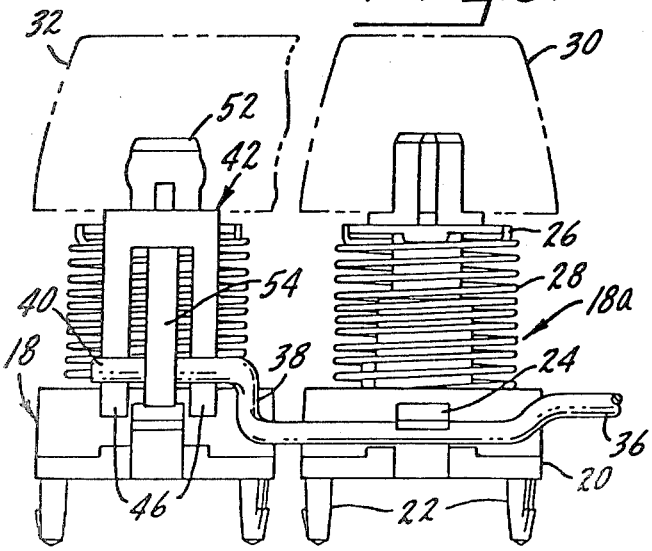
Fig. 5.
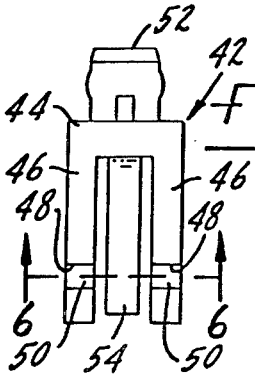
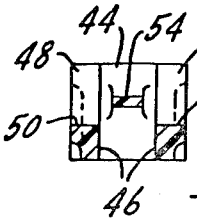
Fig. 6.

KEYBOARD SPACE BAR STABILIZER

SUMMARY OF THE INVENTION

This is a continuation-in-part of application Ser. No. 359,217 filed Mar. 18, 1982 and assigned to the present assignee, now U.S. Pat. No. 4,384,796.

This invention relates generally to keyboards and is particularly concerned with apparatus for holding an elongated keytop in place in a keyboard.

A primary object of the present invention is to provide an improved attachment element for connecting a space bar of a keyboard to a load-distributing torsion rod.

Another object is an attachment element which accommodates the natural, arcuate motion of a torsion rod.

Another object is an attachment element which continuously maintains positive engagement with the torsion rod to hold the space bar in place.

Another object is an attachment element of the type described which can be made in a single piece.

Another object is an attachment element which can be a molded, plastic part.

Another object is an attachment element of the type described which will not adversely affect the actuation force of the space bar.

Other objects will appear in the following specification, drawings and claims.

BRIEF DESCRIPTION OF THE DRAWINGS

FIG. 1 is a perspective view of a typical keyboard assembly, including a space bar.

FIG. 2 is a plan view of an end portion of a space bar showing the attachment element connected to a torsion rod which is supported by keys in an adjacent row, the keytops of those keys being removed for clarity.

FIG. 3 is a front elevation view of FIG. 2 showing the connection of an attachment element to the space bar and a torsion rod, and the connection of the torsion rod to a key in an adjacent row.

FIG. 4 is an end elevation view of a space bar, attachment element and torsion rod, as viewed from the left of FIG. 3.

FIG. 5 is a front elevation view of an attachment element.

FIG. 6 is a section of an attachment element, taken substantially along line 6—6 of FIG. 5.

DESCRIPTION OF A PREFERRED EMBODIMENT

Figure 7:
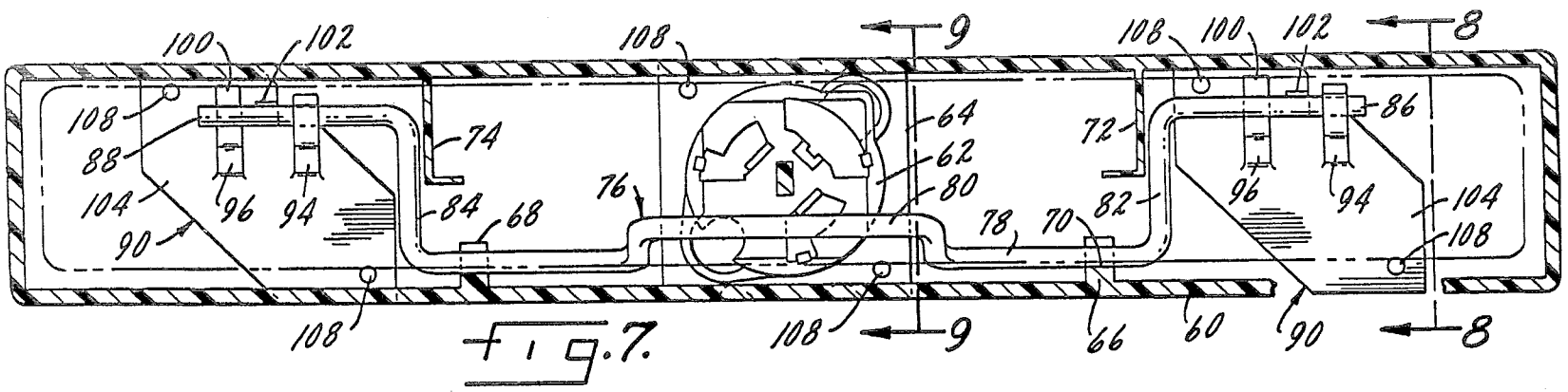
FIG. 7 is a plan view of an alternate embodiment, showing an elongated keytop with the top of the keytop removed to expose the underlying components.

The present invention relates to keyboard assemblies and components therefor. Such keyboards are customarily used in electronic typewriters, computer terminals and other data entry devices. The invention is particularly concerned with support structures for keys having an elongated keytop, such as a space bar on a standard typewriter keyboard.

One of the important factors in the manufacture of economical keyboard assemblies is flexibility in the location and type of keys. This has lead to the use of individual keys having a housing, a plunger slidable therein, a keytop mounted on the plunger, and a spring return for the plunger. Electrical contacts are provided either as part of the key housing, or as part of the base on which the key rests, e.g., a membrane switch panel. An operator causes actuation of the contacts by depressing the keytop and plunger. The normal sized keytop is usually about the same width as the housing. Consequently, the operator will always hit the key directly above the plunger and it will move up and down freely. However, an elongated keytop, such as a space bar, creates a special problem with respect to plunger motion. Because the space bar will be actuated at locations remote from the plunger, means must be provided to prevent the plunger from binding in the housing. Such means may include slidable guides at or near the ends of the space bar, with the guides sliding in slotted members attached to the base of the keyboard. While this method is serviceable, it has the drawback of necessitating special parts for the space bar and special mounting arrangements on the baseplate. It is preferable to avoid this multiplication of parts and mounting provisions.

One way of avoiding the above-described difficulties is to use a load-distributing torsion rod connected to the space bar and supported from the keys in the keyboard row adjacent to the space bar. This configuration is shown and described in U.S. Pat. No. 4,367,380, issued Jan. 4, 1983. The torsion rod allows the space bar to be mounted solely on a conventional plunger and housing with the torsion rod being used to prevent binding. The torsion rod has a crank arm at each end which is connected to the space bar. In the past it has been a problem to connect these crank arms in a manner which fully supports the space bar while simultaneously allowing the arcuate motion of the crank arm when the space bar is actuated.

Another difficulty with a space bar mounted on a single plunger and housing is the space bar tends to wobble or rattle on its mounting. The space bar plunger cannot be rigidly mounted in its housing because the necessary freedom of motion requires a certain amount of play between the plunger and the housing. While this play is negligible with a short keytop, it is multiplied by the length of a space bar and can become unacceptable. Space bar rattling is at least an annoyance and can be commercially damaging as it gives the impression that the keyboard is poorly constructed. The present invention provides an attachment element for connecting a torsion rod to the space bar which accomplishes the objects of eliminating rattle while accommodating the necessary motion of the space bar and torsion rod.

Looking at FIG. 1, a keyboard assembly is shown generally at 10. The assembly includes a baseplate 12 formed from a material which is substantially rigid. Aluminum on the order of 0.060 inches thick has been found to be satisfactory although other materials could be used. A membrane switch panel 14 is positioned on the baseplate. The membrane switch panel may be of a type well known in the art and consists generally of a membrane and a substrate, one or both of which may be flexible, and each of which has an array or pattern of electrical conductors and contacts formed thereon. A spacer normally maintains the membrane and substrate in a spaced relation with the application of local pressure by the keys causing electrical contact between the conductors through spacer openings. The membrane switch panel 14 has one or more tails 16 for connecting the conductors associated electronics. The keyboard assembly 10 includes a plurality of individual keys 18. In FIG. 1 the keys are shown in a standard typewriter configuration, together with an auxiliary key section at the right-hand side of the keyboard.

FIGS. 2 and 3 show the parts of the keys 18 in more detail. Each key includes a housing 20 which is affixed to the baseplate 12 by legs 22 which extend through openings in the baseplate. Near the base of the housing is a hook 24 which can be used to capture and retain a torsion rod. A plunger 26 is slidable in a cavity in the housing 20. It will be understood that the plunger has interior parts which actuate the electrical contacts. A spring 28 holds the plunger in a normally raised position. A keytop 30 is shown in phantom in FIG. 3. Further details of the housing and plunger can be found in the above referenced patent application.

The space bar 32 is rigidly connected to a plunger which in turn is movable in housing 34 (FIG. 1). The plunger and housing are the same as those for the other keys and they are generally mounted near the center of the space bar 32. It can be seen that user-applied pressure near one of the ends of the space bar 32 would cause the plunger to bind in the housing 34 if provision were not made for distributing the actuating pressure. The load-distributing function is performed by a torsion rod 36 (FIGS. 2 and 3). The torsion rod is an elongated wire which is rotatably mounted in two or more of the hooks 24. The hooks engaging the torsion rod 36 are located in the keyboard row adjacent to the space bar 32. In the configuration shown, specific keys 18*a* and 18*b* are the ones to which the torsion rod is attached. The ends of the torsion rod are bent at a 90° angle to form a crank arm 38. Another 90° bend on the end of the crank arm forms a finger portion 40. It is the finger 40 which is actually engaged by the attachment element of the present invention.

The attachment element 42 is shown in FIGS. 5 and 6. The element includes a body portion 44 having two legs 46. Each leg has a slot 48 which is open on one side and extends partially through the leg 46, ending with a closed base 50. A head 52 is located on the top of the attachment element. The head connects to a slot molded in the underside of the space bar 32, so the space bar is rigidly connected to the attachment element by the head 52. Depending from the body portion 44 is an elongated spring element 54. The spring is flexible and is spaced somewhat from the closed end 50 of slots 48, as best shown in FIG. 6.

As shown in FIGS. 2, 3 and 4, the finger portion 40 of crank arm 38 is disposed in the slots 48 of the attachment element 42. So the attachment element is in the nature of a yoke. More particularly, the finger 40 is located between the closed base 50 of the slots and the spring 54. FIG. 4 shows that the diameter of the finger 40 is about equal to the height of the slots 48. There is sufficient clearance to permit the finger to slide back and forth horizontally in the slots but vertical sliding is prevented. So the finger is essentially trapped between the surfaces of the slots 48 and the spring 54. There is a slight preload on the spring 54, even when the finger portion 40 is fully contacting the base 50 of the slots 48. Thus, the spring flexibly engages the finger portion of the crank arm 38.

When the space bar 32 is actuated, the space bar moves vertically up and down, as it is constrained to do by its plunger and housing. Therefore, the attachment elements 42 at either end of the space bar also move in a vertical direction. However, the finger 40 of the crank arm 38 moves in an arcuate manner. That is, the finger describes an arc 56 (FIG. 4) as it moves with the attachment element. This means the finger portion has both vertical and horizontal components in its motion. The slots 48 in the attachment element accommodate the horizontal component of the crank arm's motion. As shown in phantom in FIG. 4, when the space bar moves downwardly, the crank arm finger moves toward the open end of the slot 48 and the spring 54 flexes outwardly with the finger 40. When the space bar returns to its normal, raised position the finger moves back toward the base 50 of the slot 48. The spring 54 is always in contact with the finger 40. Thus, the attachment element is constantly engaged with the crank arm so that the space bar 32 will not rattle or wobble on its mounting.

One of the advantages of the attachment element of this invention is that the geometry of the attachment element allows a sizable spring force on the crank arm without affecting the actuation force of the space bar itself. Also, if desired the spring 54 can be formed as an integral part of the attachment element. In this case the element is preferably molded from an acetyl resin, such as Delrin sold by DuPont. Alternately, the spring 54 could be made of metal and inserted into the body portion 44 of the attachment element. Or the spring could be connected directly to the space bar.

Figure 9:
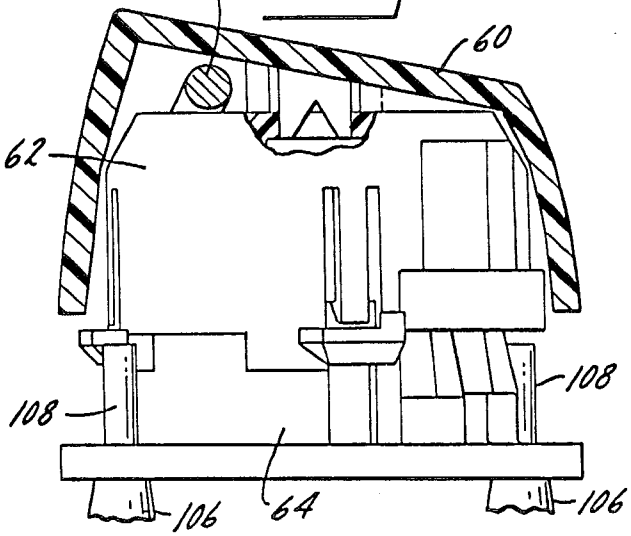
FIG. 9 is a section taken substantially along line 9—9 of FIG. 7.
Figure 8:
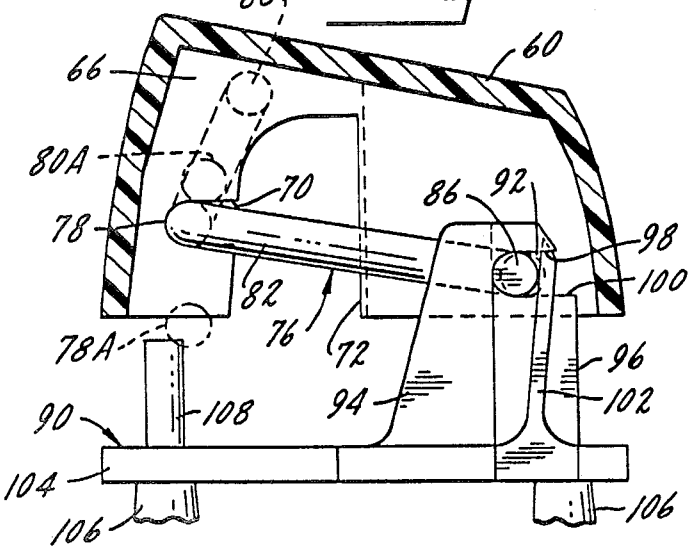
FIG. 8 is a section taken substantially along line 8—8 of FIG. 7.

FIGS. 7–9 show an alternate embodiment. In the embodiment of FIGS. 1–6 the torsion rod is pivotally connected to the keyboard assembly and flexibly attached to the elongated keytop. The embodiment of FIGS. 7–9 reverses that arrangement in that the torsion rod is pivotally connected to the elongated keytop and flexibly attached to the keyboard baseplate. Also, in the alternate embodiment, the means for balancing the actuating force about the plunger are self-contained. That is, the torsion rod and its mounting elements fit entirely underneath the elongated keytop.

Turning now to the details of FIGS. 7–9, an elongated keytop 60 is connected to a plunger 62 which is reciprocable in a housing 64. The housing and plunger are described in detail in application Ser. No. 473,032, filed Mar. 7, 1983 and assigned to the present assignee.

The elongated keytop 60 includes webs 66 and 68 which are molded in the underside thereof. The webs include a notch 70 which receives the shank of the torsion rod. The torsion rod is pivotally mounted in the notch 70 of the webs. The webs 66 and 68 merge with a pair of L-shaped stops 72 and 74. The stops engage the torsion rod crank arms to prevent longitudinal motion of the torsion rod.

The torsion rod itself is shown at 76. It includes a shank 78 which has a central offset portion 80. The offset section allows the shank to bypass the plunger 62. Thus, the offset portion 80 is trapped between the keytop 60 and the plunger 62, as best shown in FIG. 9. The torsion rod has crank arms 82 and 84 at either end. The crank arms in turn have elongated fingers 86 and 88.

The elongated fingers of the torsion rod are disposed in attachment elements shown generally at 90. The attachment elements are identical so only one of them will be described in detail. The attachment element 90 has an enclosure 92 (FIG. 8). The enclosure receives the elongated fingers of the torsion rod crank arms. The enclosure is defined by a pair of legs 94 and 96. Each leg has a slide surface which engages the elongated finger of the crank arm. Leg 94 has a slide surface 98 which is located above the finger 86. In other words, the leg 94 defines a hook element which extends above the finger. The leg 96, on the other hand, has a slide surface 100 which is underneath the finger 86. Thus, the two surfaces cooperate to restrain the torsion rod in a vertical direction. This configuration has an advantage in molding the attachment element 90 out of plastic. With this arrangement no side cores are necessary in the molding process.

The enclosure 92 is further defined by a cantilever spring 102. The spring 102 flexibly engages the elongated fingers of the crank arms to secure the fingers in the enclosure. When the key is actuated, the torsion rod will be pivoted to its down position (indicated schematically at 78A and 80A in FIG. 8). The elongated fingers of the crank arms will exhibit horizontal motion within the enclosure of the attachment elements. The spring 102 accommodates this motion while preventing the fingers from entirely slipping out of the enclosure. When the elongated keytop is in its normal, raised position the spring 102 engages the torsion rod to prevent any vibration of the keytop.

The attachment element 90 has a base 104 having expandable rivets 106 molded to the underside thereof. The rivets are placed through holes in the keyboard baseplate, after which pegs 108 may be driven into the rivets to expand them and thereby secure the attachment element to the keyboard baseplate. FIG. 9 illustrates the identical arrangement for attachment of the housing 64 to the keyboard baseplate. Preferably, the spacing of the rivets on the attachment elements is the same as that on the key housings. Thus, the housings and attachment elements can be fastened to the keyboard baseplate in the same manner. It is also preferred that the spacing of the attachment elements from the key housing be the same as or an integral multiple of the spacing between the other keys in the keyboard array. This facilitates punching of the mounting holes in the keyboard baseplate in that they can be punched at uniform intervals and the attachments elements 90 will fit into this pattern regardless of where the elongated keytop is placed on the board.

I claim:

1. In a keyboard assembly, a baseplate, a plurality of keys attached to the baseplate, at least one of the keys having an elongated keytop supported by a torsion rod having crank arms, and an attachment element connected directly to the baseplate for connecting the torsion rod to the keyboard assembly, including an enclosure formed in the attachment element, a crank arm being disposed in the enclosure and free to slide therein when the key is actuated, the enclosure being defined by at least one leg having slide surfaces and a spring which flexibly engages the crank arm to secure the crank arm in the enclosure.

2. The structure of claim 1 wherein the enclosure is defined by two legs, one leg having a slide surface underneath the torsion rod, the other leg having a slide surface above the torsion rod, the two surfaces cooperating to restrain the torsion rod in a vertical direction.

3. In a keyboard assembly, a baseplate, a plurality of keys attached to the baseplate, each key having a housing, a plunger reciprocable in the housing and a keytop attached to the plunger, at least one of the keys having an elongated keytop, the improvement comprising means for balancing key actuating force on an elongated keytop about its plunger, said means being contained within the space underneath the elongated keytop and including a torsion rod pivotally connected to the keytop and having crank arms at either end, a pair of attachment elements connected to the baseplate and each having an enclosure for receiving the crank arms, the enclosure being defined by at least one leg having slide surfaces and a spring which flexibly engages the crank arm to secure the crank arm in the enclosure while allowing it to slide therein when the key is actuated.

4. The structure of claim 3 further comprising stops on the underside of the elongated keytop which engage the crank arms to prevent longitudinal motion of the torsion rod.

5. The structure of claim 3 wherein the enclosure is defined by two legs, one leg having a slide surface underneath the torsion rod, the other leg having a slide surface above the torsion rod, the two surfaces cooperating to restrain the torsion rod in a vertical direction.

6. The structure of claim 3 wherein the attachment element and the key housing include identical means for attachment to the baseplate.

* * * * *